US005997039A

United States Patent [19]

Manninen

[11] Patent Number: 5,997,039

[45] **Date of Patent: *Dec. 7, 1999**

[54] MEANS FOR FASTENING THE HAND TO A SKI POLE

[75] Inventor: Taisto Manninen, Mäntyharju, Finland

[73] Assignee: Exel Oy, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 09/163,438

[22] Filed: Sep. 30, 1998

[30] Foreign Application Priority Data

Oct. 13, 1997 [FI] Finland ..... 973940

[51] Int. Cl.[6] ..... A63C 11/00

[52] U.S. Cl. ..... 280/821; 2/160; 2/161.1; 2/162; 2/917; 24/200; 24/171; 24/196

[58] Field of Search ..... 280/821, 822, 280/819; 24/200, 265 EC, 265 BC, 570, 171, 196, 169; 2/160, 161.1, 162, 917

[56] References Cited

U.S. PATENT DOCUMENTS

| | | | |
|---|---|---|---|
| 2,169,402 | 8/1939 | White | 24/200 |
| 2,293,562 | 8/1942 | Rosenthal | 24/200 |
| 2,595,139 | 4/1952 | Hart | 450/28 |
| 3,369,842 | 2/1968 | Adams | 297/483 |
| 4,484,379 | 11/1984 | Appelt | 24/197 |
| 5,092,629 | 3/1992 | Bagneres et al. | 280/821 |
| 5,123,153 | 6/1992 | Krauss | 24/196 |
| 5,123,674 | 6/1992 | Bagneres | 280/821 |
| 5,371,926 | 12/1994 | Van Noy | 24/171 |
| 5,722,092 | 3/1998 | Borzecki et al. | 2/16 |

FOREIGN PATENT DOCUMENTS

| | | |
|---|---|---|
| 0357517 | 3/1990 | European Pat. Off. . |
| 0579149 | 1/1994 | European Pat. Off. . |
| 94492 | 9/1995 | Finland . |
| 19033 | 7/1997 | Finland . |
| 9634665 | 11/1996 | WIPO . |

*Primary Examiner*—Judy J. Swann
*Assistant Examiner*—Andrew J. Ririe
*Attorney, Agent, or Firm*—Rothwell, Figg, Ernst & Kurz, p.c.

[57] ABSTRACT

A harness for securing a hand to a ski-pole grip, the harness including a thumb hole, a protector element extending from an area between a thumb and a forefinger of the hand to a wrist area, surrounding at least partially a thumb-side outer edge of the hand, and at least one wrist-encircling tightening strap, wherein the protector is provided with at least one adjustment strap, extending in a substantially wrist-encircling direction and fitted with a fastening buckle which is intended for cooperation with the tightening strap and whose position along the adjustment strap is adjustable longitudinally of the adjustment strap according to a size of the hand.

9 Claims, 4 Drawing Sheets

MEANS FOR FASTENING THE HAND TO A SKI POLE

BACKGROUND OF THE INVENTION

1. Field of the Invention

The present invention relates to a harness-like fastening means for securing the hand to the grip of a ski pole, said fastening means including a thumb hole, a protector element extending from the area between the thumb and forefinger to the wrist area, surrounding at least partially the thumb-side outer edge of the hand, and a wrist-encircling tightening strap.

2. Description of the Background Art

The present Applicant's earlier Finnish design registration M19033 discloses this type of harness-like fastening means. FIG. 1 illustrates schematically a harness-like fastening means as set forth in the cited design registration. As shown in FIG. 1, the fastening means 1 includes a thumb hole 2 and a protector element 4 which extends from the area between the thumb and forefinger to the wrist area and surrounds at least partially the thumb-side outer edge of the hand. From one edge of the protector element 4 extends a tightening strap 5 intended for extending around the wrist on the side of the wrist opposite to the protector element 4. The protector element 4 has its top portion (in the operative position of the fastening means 1 shown in FIG. 1) fitted with a fastening buckle 6, the tip of the tightening strap 5 extending through a slot therein so as to be foldable back on itself. In order to secure it, the tightening strap 5 is provided with hook and loop fasteners 5*a*. The fastening means is attached to a ski-pole grip 3 at an anterior area 9 of the thumb hole 2. One drawback in this type of solution is that the fastening means must be manufactured in a wide variety of sizes according to the size of a user's hand.

SUMMARY OF THE INVENTION

Hence, an object of the present invention is to provide an improved harness-like fastening means which enables, in a relatively simple manner, the use of a single size fastening means in connection with a variety of hand sizes. In order to achieve this object, a harness-like fastening means of the invention is characterized in that the protector element is provided with an adjustment strap, extending in a substantially wrist-encircling direction and fitted with a fastening buckle which is intended for cooperation with the tightening strap and whose position along the adjustment strap is adjustable longitudinally of the adjustment strap according to the size of a user's hand.

BRIEF DESCRIPTION OF THE PREFERRED EMBODIMENTS

The invention will now be described in more detail with reference made to the accompanying drawings, in which:

In FIGS. 1–4, the corresponding parts are designated with corresponding reference numerals.

DETAILED DESCRIPTION OF THE PREFERRED EMBODIMENTS

Figure 1:
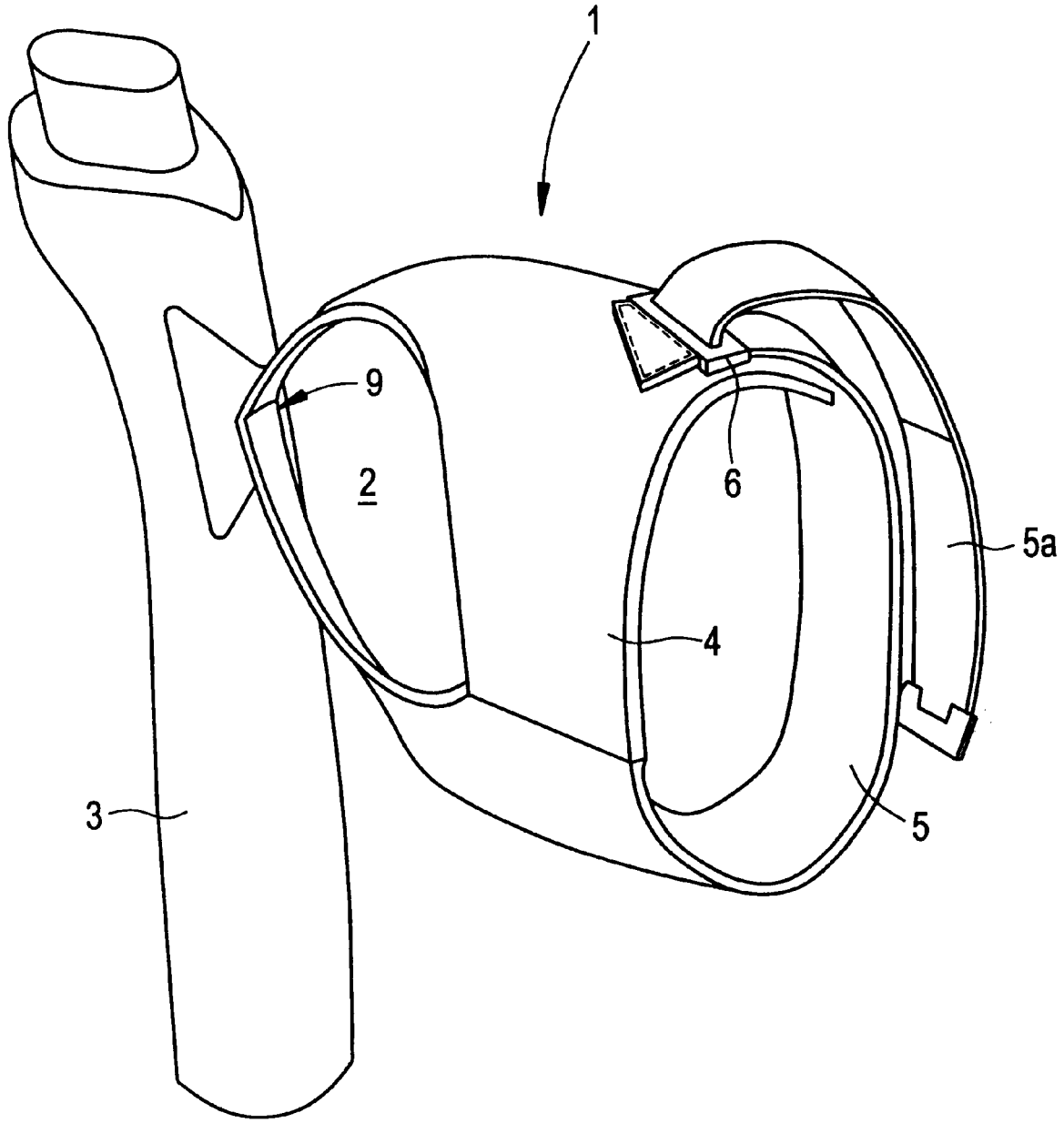
FIG. 1 PRIOR ART
FIG. 1 shows a harness-like fastening means according to the prior art.
Figure 2:
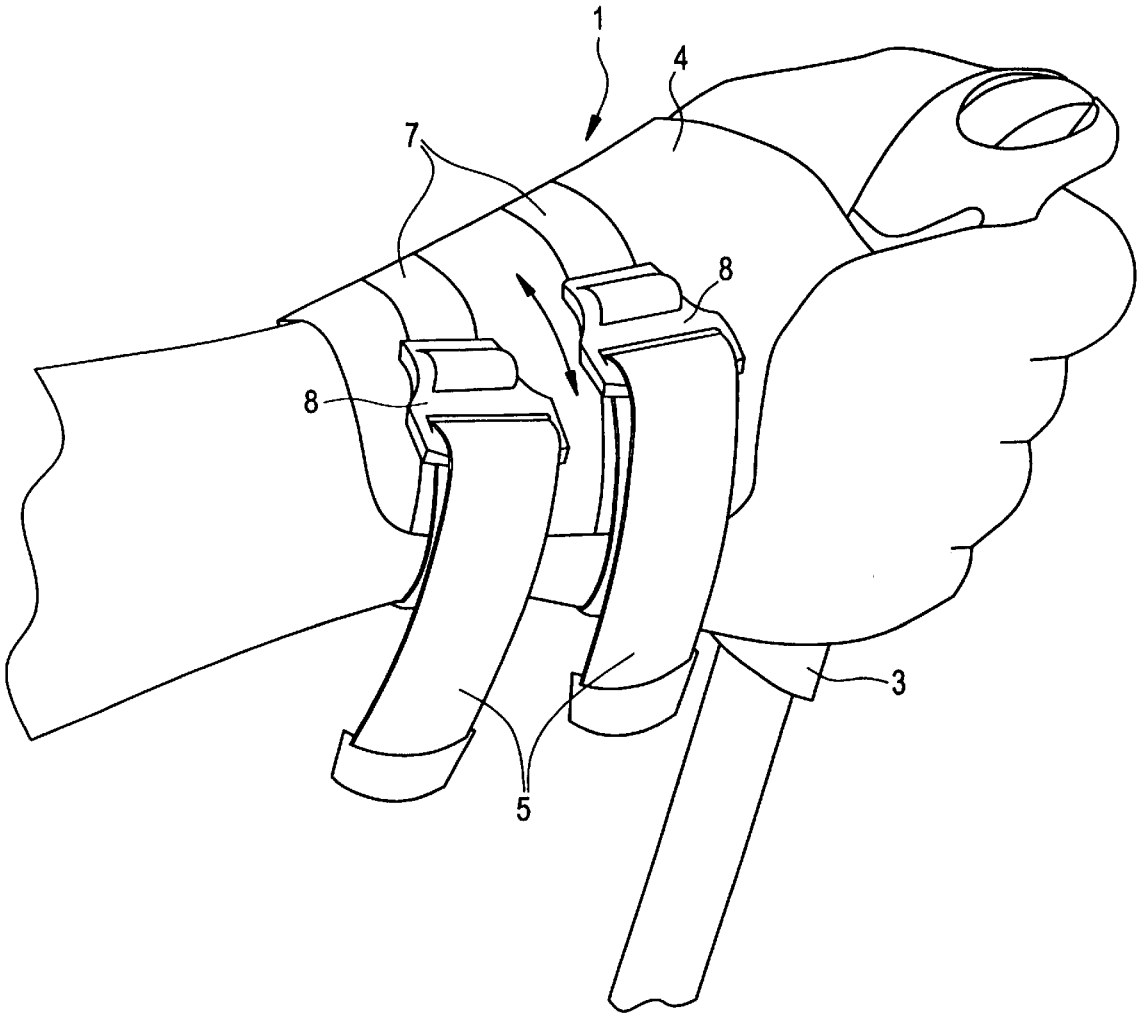
FIG. 2 shows a harness-like fastening means of the invention according to one embodiment thereof in a schematic perspective view.
Figure 3:
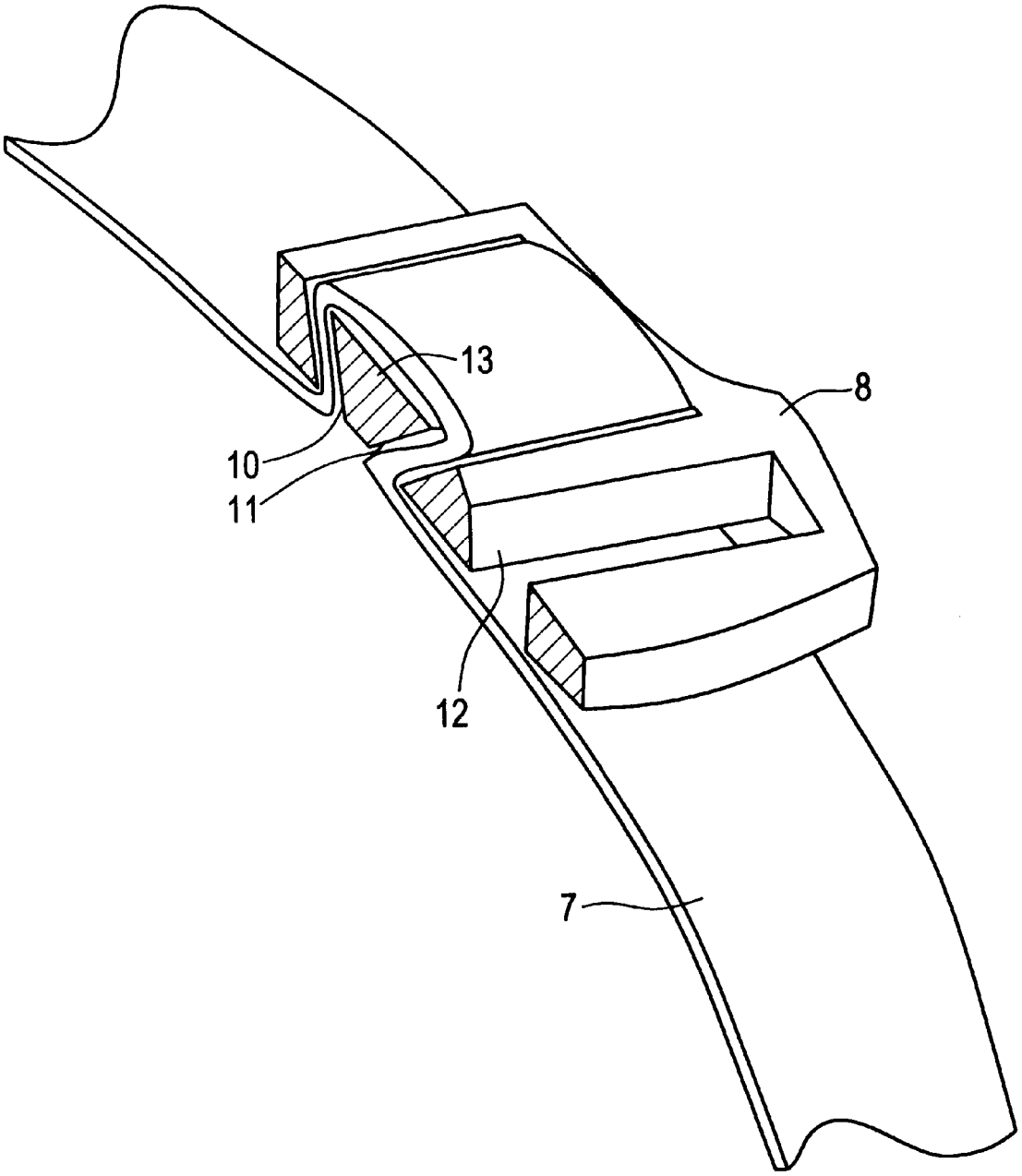
FIG. 3 shows one detail in a harness-like fastening means of the invention in a sectional view.
Figure 4:
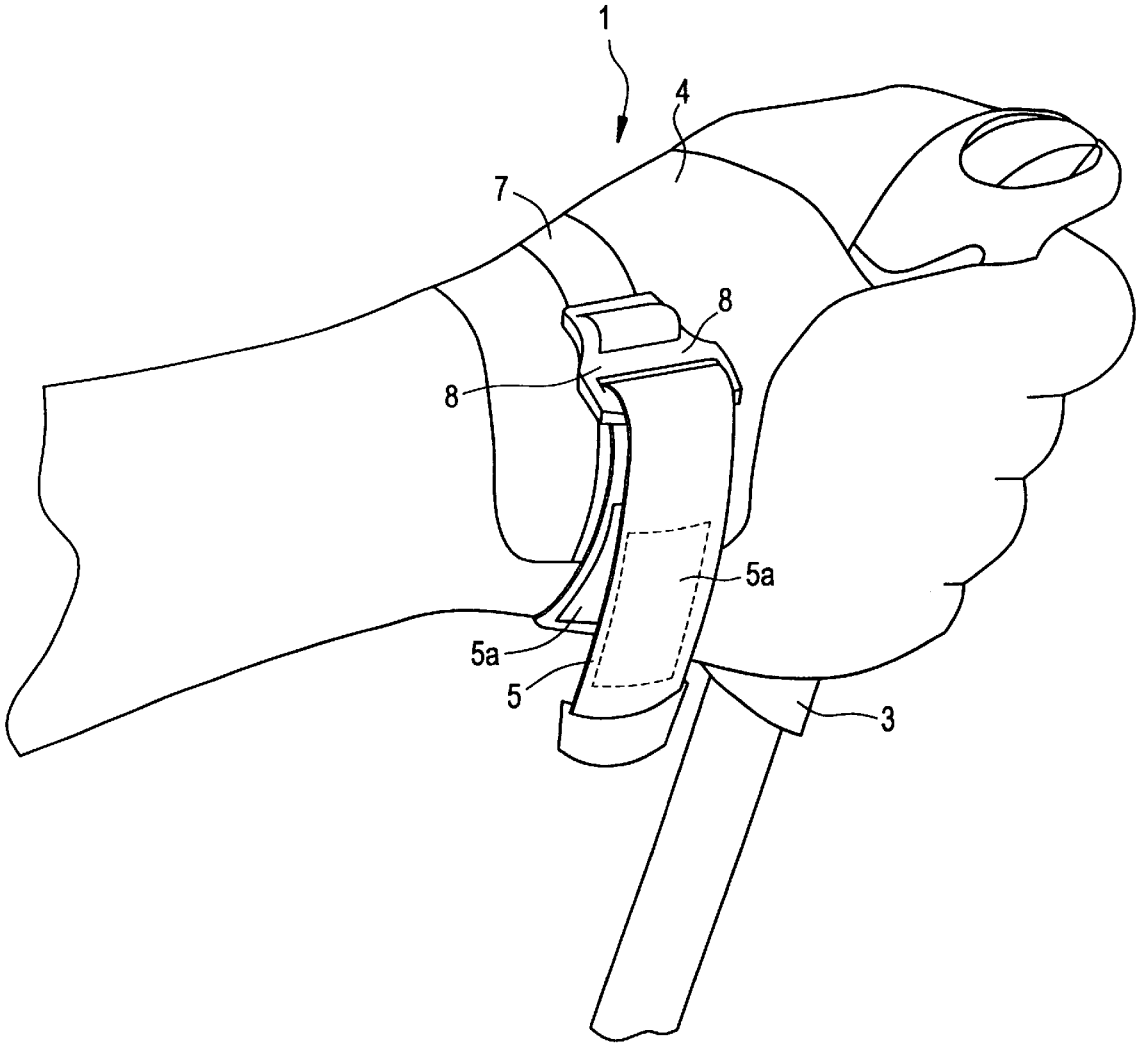
FIG. 4 shows a harness-like fastening means of the invention according to another embodiment thereof in a schematic perspective view.

The embodiments depicted in FIGS. 2 and 4 differ from the prior art solution of FIG. 1 in that the protector element 4 is provided with an adjustment strap 7, extending in a wrist-encircling direction and secured to the protector element preferably at both lengthwise ends thereof. This adjustment strap is fitted with a buckle 8, which is movable along the adjustment strap 7. The adjustment strap 7 is preferably adapted to extend, as shown in FIG. 3, through slots 10 and 11 present in the buckle 8 around a stay element 13. The buckle 8 further includes a slot 12 for passing the tightening strap 5 therethrough. The tip of the tightening strap 5 extends through a slot in the buckle 8 so as to be foldable back on itself. In order to secure the end of the tightening strap 5, it is provided with hook and loop fasteners 5*a* (see FIG. 4). In the embodiment shown in FIG. 2, the protector element 4 is provided with two adjustment straps 7, including the buckle members 8 thereof, while FIG. 4 depicts a fastening means provided with just one adjustment strap 7 and tightening strap 5. It is also conceivable to implement the invention by using more than two adjustment and tightening straps.

The primary function of the protector element is to serve as an attachment backing for the buckle and as a protection against the buckle pressing on the hand of a user. The useful material for a fastening means comprises e.g. fabric, leather, polyurethane, and combinations thereof.

What is claimed is:

1. A harness for securing a hand to a ski-pole grip, said harness including:

a thumb hole;

a protector element extending from an area between a thumb and a forefinger of said hand to a wrist area, surrounding at least partially a thumb-side outer edge of said hand; and at least one wrist-encircling tightening strap;

wherein said protector element is surrounded by at least one adjustment strap, said adjustment strap being separate from said tightening strap, said adjustment strap extending in a substantially wrist-encircling direction and fitted with a fastening buckle, the fastening buckle being intended for cooperation with said tightening strap and the fastening buckle being longitudinally adjustable along said adjustment strap according to a size of said hand;

wherein a size adjustment of said harness may be effected by both sliding said fastening buckle on said adjustment strap and by taking in or paying out a free end of said tightening strap such that fastener components located on each of said harness and tightening strap will be able to align with each other.

2. The harness of claim 1, wherein said tightening strap passes once through said fastening buckle, with a resulting free end of said tightening strap being held against said harness by hook and loop fastener components positioned on said harness and on said free end of said tightening strap.

3. The harness of claim 1, wherein a size adjustment of said harness may be effected by both sliding said fastening buckle on said adjustment strap and by taking in or paying out a free end of said tightening strap.

4. The harness of claim 1, wherein said fastening buckle includes three slots through which the adjustment strap passes once through each of two of the said three slots and the tightening strap passes once through one of the said three slots.

5. The harness of claim 1, wherein said adjustment strap passes twice through said fastening buckle in order to hold said fastening buckle at a predetermined location of said adjustment strap while allowing a user to move said fastening buckle relative to said adjustment strap.

6. The harness of claim 1, wherein said harness further includes two adjustment straps, two tightening straps, and two fastening buckles.

7. The harness of claim 1, wherein said harness is a fabric.

8. The harness of claim 1, wherein said harness is leather.

9. The harness of claim 1, wherein said harness is polyurethane.

* * * * *